US010343399B2

(12) United States Patent
Naito

(10) Patent No.: US 10,343,399 B2
(45) Date of Patent: Jul. 9, 2019

(54) LIQUID JETTING APPARATUS AND METHOD FOR MANUFACTURING LIQUID JETTING APPARATUS

(71) Applicant: BROTHER KOGYO KABUSHIKI KAISHA, Nagoya-shi, Aichi-ken (JP)

(72) Inventor: Kyohei Naito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/720,039

(22) Filed: Sep. 29, 2017

(65) Prior Publication Data

US 2018/0104952 A1 Apr. 19, 2018

(30) Foreign Application Priority Data

Oct. 18, 2016 (JP) ..... 2016-204055

(51) Int. Cl.
*B41J 2/14* (2006.01)

(52) U.S. Cl.
CPC ..... *B41J 2/14233* (2013.01); *B41J 2/14032* (2013.01); *B41J 2/14072* (2013.01); *B41J 2002/14241* (2013.01); *B41J 2002/14491* (2013.01)

(58) Field of Classification Search
CPC ..... B41J 2/14233; B41J 2/14072; B41J 2/14032; B41J 2002/14491; B41J 2002/14241
See application file for complete search history.

(56) References Cited

U.S. PATENT DOCUMENTS

| | | | | |
|---|---|---|---|---|
| 6,176,570 | B1 | 1/2001 | Kishima et al. | |
| 2001/0001458 | A1* | 5/2001 | Hashizume | B41J 2/14233 216/2 |
| 2005/0068378 | A1* | 3/2005 | Sanada | B41J 2/14233 347/68 |
| 2006/0181582 | A1 | 8/2006 | Sugahara | |

FOREIGN PATENT DOCUMENTS

| | | | |
|---|---|---|---|
| JP | 9-39232 | A | 2/1997 |
| JP | 2006-256317 | A | 9/2006 |

* cited by examiner

*Primary Examiner* — Geoffrey S Mruk
(74) *Attorney, Agent, or Firm* — Merchant & Gould P.C.

(57) ABSTRACT

A liquid jetting apparatus includes: a channel substrate having a pressure chamber which is long in a first direction; an insulating film provided on the channel substrate to cover the pressure chamber; a piezoelectric film overlapping with the insulating film and having first and second portions, the first portion overlapping with a central portion of the pressure chamber in the first direction, the second portion extending from the first portion in the first direction beyond the pressure chamber, the first portion having a width in a second direction which is smaller than a width of the pressure chamber in the second direction; a first electrode arranged between the insulating film and the piezoelectric film; and a second electrode facing the first electrode with the piezoelectric film being sandwiched therebetween. The insulating film has a thin-walled portion formed at a portion overlapping with the second portion of the piezoelectric film.

10 Claims, 14 Drawing Sheets

LIQUID JETTING APPARATUS AND METHOD FOR MANUFACTURING LIQUID JETTING APPARATUS

CROSS REFERENCE TO RELATED APPLICATION

The present application claims priority from Japanese Patent Application No. 2016-204055, filed on Oct. 18, 2016, the disclosure of which is incorporated herein by reference in its entirety.

BACKGROUND

Field of the Invention

The present invention relates to a liquid jetting apparatus and a method for manufacturing a liquid jetting apparatus.

Description of the Related Art

There is known a liquid jetting apparatus including a piezoelectric actuator, that applies pressure to liquid in a pressure chamber to jet the liquid from a nozzle. The above-described piezoelectric actuator generally includes a piezoelectric element having: a film covering the pressure chamber; a piezoelectric film; and two kinds of electrodes sandwiching the piezoelectric film. Moreover, there is known an actuator in which thickness of the film covering the pressure chamber has been partially thinned at a portion overlapping with an edge of the pressure chamber.

In a certain liquid jetting apparatus, a vibrating plate of two-layer structure is laminated on the pressure chamber having a shape which is long in one direction has, and the piezoelectric element is disposed on the vibrating plate. A lower layer of the vibrating plate covers an entire region of the pressure chamber. On the other hand, an upper layer of the vibrating plate and the piezoelectric element on the upper layer of the vibrating plate have a width in a transverse direction which is smaller than that of the pressure chamber and are disposed to overlap with a central portion of the pressure chamber in the transverse direction. In other words, in relation to the transverse direction, thickness of the vibrating plate is thick in a portion overlapping with the central portion directly below the piezoelectric element and is thin in a portion overlapping with an edge of the pressure chamber. Note that in the central portion in the transverse direction, the two layers of vibrating plates are disposed in the longitudinal direction over an entire length of the pressure chamber, and thickness of the vibrating plate is constant in relation to the longitudinal direction.

In another liquid jetting apparatus, the vibrating plate covering the pressure chamber has the piezoelectric film disposed thereon to overlap with the entire region of the pressure chamber. A looped groove extending along the edge of the pressure chamber is formed in a back surface of the vibrating plate. An individual electrode is disposed on an upper side of the piezoelectric film, and a common electrode is disposed on a lower side of the piezoelectric film. Note that in this liquid jetting apparatus, the individual electrode includes: a portion overlapping with the central portion of the pressure chamber; and a portion (a trace portion) extending in the longitudinal direction beyond an edge of the pressure chamber. In other words, the piezoelectric film is sandwiched between the individual electrode and the common electrode not only in the portion overlapping with the central portion of the pressure chamber but also in the portion overlapping with the end portion in the longitudinal direction of the pressure chamber where the above-described wiring line section of the individual electrode is disposed.

In a piezoelectric actuator provided in these liquid jetting apparatuses, when a voltage is applied between the individual electrode and the common electrode, the piezoelectric film sandwiched between the two electrodes contracts due to an inverse piezoelectric effect. This contraction causes the actuator as a whole to bend convexly downwards, that is, toward the pressure chamber. As a result of this bending of the actuator, capacity of the pressure chamber decreases, and the liquid is jetted from a nozzle communicating with the pressure chamber.

SUMMARY

In the case that the piezoelectric film is sandwiched by the individual electrode and the common electrode even in the portion overlapping with the end portion in the longitudinal direction of the pressure chamber, when a voltage is applied between the individual electrode and the common electrode, contraction in a surface direction due to the inverse piezoelectric effect occurs in the piezoelectric film, not only at the portion overlapping with the central portion of the pressure chamber but also at the portion overlapping with the end portion in the longitudinal direction of the pressure chamber. At this time, the portion, of the piezoelectric film, overlapping with the end portion in the longitudinal direction of the pressure chamber has its deformation constrained on an edge side of the pressure chamber, hence bending to an upper side occurs in the actuator. As a result of the bending to an upper side in a position overlapping with the end portion in the longitudinal direction of the pressure chamber, displacement in a downward direction in the position overlapping with the central portion of the pressure chamber becomes small and energy provided to the liquid in the pressure chamber decreases.

In order to suppress bending of the actuator in the position overlapping with the end portion in the longitudinal direction of the pressure chamber, a neutral surface of the actuator in this end portion is preferably brought close to a central position in a thickness direction of the piezoelectric film which is a contracting portion. Note that a neutral surface of the actuator refers to a neutral surface of an entire laminated body of a plurality of kinds of films including the film covering the pressure chamber, the piezoelectric film, and the two kinds of electrodes. When this neutral surface of the actuator is close to the central position in the thickness direction of the piezoelectric film, it becomes difficult for contraction due to piezoelectric deformation of the piezoelectric film to be converted into bending of the actuator. Although there are several measures for bringing the neutral surface of the actuator close to the central position in the thickness direction of the piezoelectric film, it is easy for the film covering the pressure chamber to be thinned. That is, it is only required that thickness of the above-described film is thinned in the position overlapping with the end portion of the pressure chamber.

Incidentally, in the above-described other liquid jetting apparatus, a looped thin-walled portion is formed along the edge section of the pressure chamber in the film covering the pressure chamber. In other words, the thin-walled portion is formed in the film not only for the portion overlapping with the end portion in the longitudinal direction of the pressure chamber, but also for the portion overlapping with the end portion in the transverse direction of the pressure chamber.

However, in the case of adopting a configuration where the piezoelectric film does not cover the position, of the film covering the pressure chamber, overlapping with the end portion of the pressure chamber in the transverse direction, it is unfavorable to form the above-described kind of thin-walled portion in the portion overlapping with the end portion of the pressure chamber in the transverse direction. That is, if the thin-walled portion is formed at a portion not overlapping with the piezoelectric film, strength of the actuator lowers in this portion, and there is a risk of the actuator being damaged in the course of drive being repeated.

An object of the present teaching is to suppress bending of an actuator in an end portion of a pressure chamber in a longitudinal direction while preventing lowering of strength of a portion, of an insulating film, exposed from a piezoelectric film, and thereby increase efficiency of conversion from piezoelectric deformation to displacement of the actuator, in a position overlapping with a pressure chamber central portion.

According to a first aspect of the present teaching, there is provided a liquid jetting apparatus including: a channel substrate in which a pressure chamber is formed, the pressure chamber having a shape which is long in a first direction; an insulating film provided on the channel substrate to cover the pressure chamber; a piezoelectric film overlapping with the insulating film and having a first portion and a second portion, the first portion overlapping with a central portion of the pressure chamber in the first direction, the second portion extending from the first portion in the first direction beyond the pressure chamber, the first portion having a width in a second direction orthogonal to the first direction which is smaller than a width of the pressure chamber in the second direction; a first electrode arranged between the insulating film and the piezoelectric film, the first electrode extending in the first direction across a boundary between the first portion and the second portion of the piezoelectric film; and a second electrode facing the first electrode with the piezoelectric film being sandwiched therebetween, the second electrode extending in the first direction across the boundary between the first portion and the second portion of the piezoelectric film, wherein the insulating film has a thin-walled portion formed at a portion overlapping with the second portion of the piezoelectric film, and the thin-walled portion is thinner than an uncovered portion, of the insulating film, which is not covered by the piezoelectric film and which is positioned outside the first portion of the piezoelectric film and inside the pressure chamber with respect to the second direction.

Due to the liquid jetting apparatus according to the first aspect of the present teaching, the thin-walled portion is formed in the insulating film at the portion overlapping with the second portion of the piezoelectric film. That is, due to thickness of the insulating film being thinned at a portion overlapping with the end portion of the pressure chamber on one side in the first direction, a neutral surface of an actuator comes close to a central position in a thickness direction of the piezoelectric film, in the portion overlapping with the end portion on the one side in the first direction. As a result, in the end portion on the one side in the longitudinal direction of the pressure chamber, even if contraction occurs in the second portion sandwiched by a first electrode and a second electrode, bending of the actuator due to this contraction decreases.

Moreover, the thin-walled portion is thinner than the uncovered portion outside the first portion and inside the pressure chamber with respect to the second direction. Conversely expressed, the uncovered portion, of the insulating film, not covered by the piezoelectric film and more separated from a center of the pressure chamber in the second direction than the first portion is, is not thin. Therefore, damage of the insulating film is prevented in the above-described portion not covered by the piezoelectric film.

According to a second aspect of the present teaching, there is provided a method for manufacturing a liquid jetting apparatus, including: preparing a channel substrate in which a pressure chamber is formed, the pressure chamber having a shape which is long in a first direction; providing an insulating film on the channel substrate to cover the pressure chamber; forming a thin-walled portion in the insulating film at a portion overlapping with an end portion of the pressure chamber on one side in the first direction; forming a film of a piezoelectric material on the insulating film; and patterning the film of the piezoelectric material to form a first portion and a second portion, wherein the thin-walled portion is thinner than a portion, of the insulating film, overlapping with an end portion of the pressure chamber in a second direction orthogonal to the first direction, the first portion overlaps with a central portion of the pressure chamber in the first direction, and has a width in the second direction which is smaller than a width of the pressure chamber in the second direction, and the second portion extends from the first portion in the first direction beyond the pressure chamber.

In the method for manufacturing the liquid jetting apparatus according to the second aspect of the present teaching, the thin-walled portion is formed in the insulating film at a portion overlapping with an end portion of the pressure chamber on one side in the first direction. As a result, in the end portion of the pressure chamber on the one side in the first direction, the neutral surface of the actuator comes close to the central position in the thickness direction of the piezoelectric film. Therefore, even if the second portion disposed in the end portion of the pressure chamber on the one side in the first direction contracts, bending of the actuator is reduced. On the other hand, in the portion not covered by the piezoelectric film and positioned outside the first portion and inside the pressure chamber in relation to the second direction, lowering of strength of the actuator is suppressed, without thickness of the insulating film being made thinner than that of the thin-walled portion.

DESCRIPTION OF THE EMBODIMENTS

Figure 1:
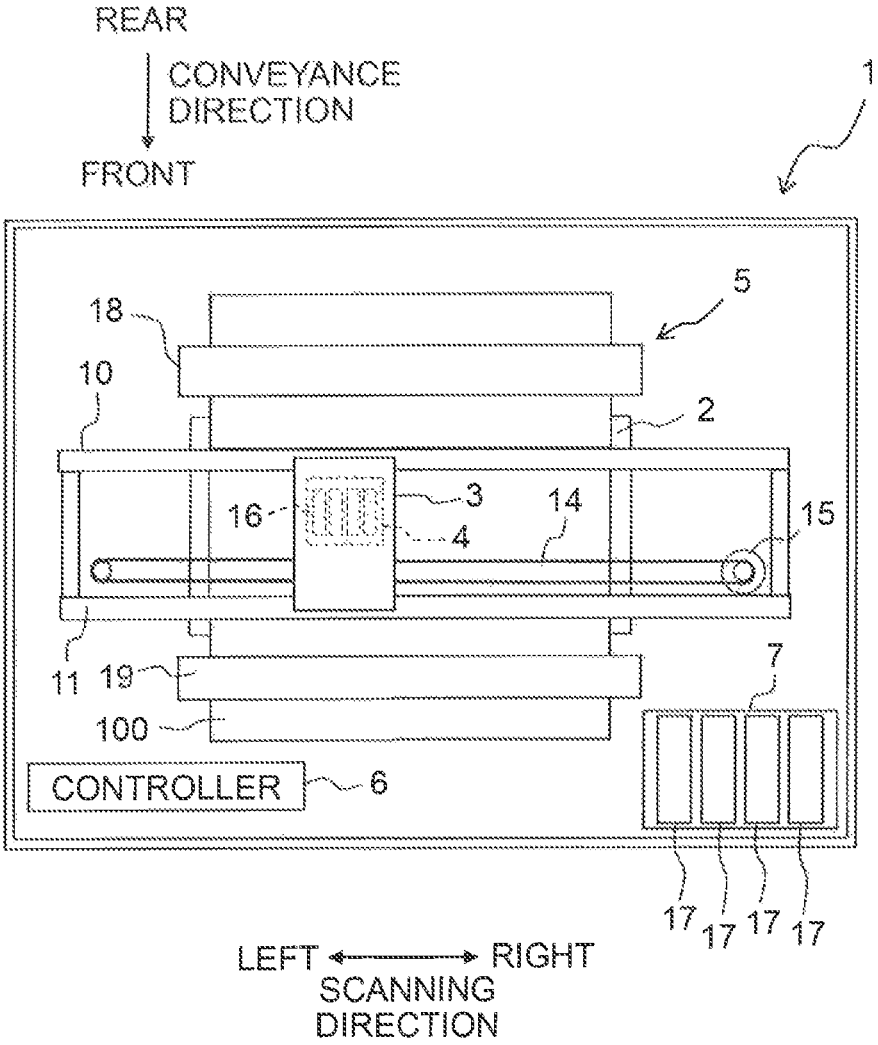
FIG. 1 is a schematic plan view of a printer according to the present embodiment.

Next, an embodiment of the present teaching will be described. First, a schematic configuration of an ink-jet printer 1 will be described with reference to FIG. 1. Note that each of directions of front/rear/left/right shown in FIG. 1 are defined as "front", "rear", "left", "right" of the printer. Moreover, this side of the paper surface is defined as "up", and the far side of the paper surface is defined as "down". Hereafter, description will be made making appropriate use of phrases for each of the directions of front/rear/left/right/up/down.

<Schematic Configuration of Printer>

As shown in FIG. 1, the ink-jet printer 1 includes a platen 2, a carriage 3, an ink-jet head 4, a conveyance mechanism 5, and a controller 6.

A recording sheet 100 which is a recording medium is placed on an upper surface of the platen 2. The carriage 3 is configured capable of reciprocating movement in a left-right direction (hereafter also called a scanning direction) along two guide rails 10, 11 in a region facing the platen 2. An endless belt 14 is coupled to the carriage 3, and the endless belt 14 is driven by a carriage drive motor 15, whereby the carriage 3 moves in the scanning direction.

The ink-jet head 4 is attached to the carriage 3 and moves in the scanning direction along with the carriage 3. The ink-jet head 4 includes four head units 16 aligned in the scanning direction. The four head units 16 are connected, by respective unillustrated tubes, to a cartridge holder 7 in which ink cartridges 17 of four colors (black, yellow, cyan, magenta) are installed. Each of the head units 16 has a plurality of nozzles 24 (refer to FIGS. 3 to 6) formed on its lower surface (a surface on the far side of the paper surface of FIG. 1). The nozzles 24 of each of the head units 16 jet toward the recording sheet 100 placed on the platen 2 ink supplied from the ink cartridge 17.

The conveyance mechanism 5 has two conveyance rollers 18, 19 disposed so as to sandwich the platen 2 in a front-rear direction. The conveyance mechanism 5 conveys the recording sheet 100 placed on the platen 2 frontwards (in what is hereafter also called a conveyance direction) by the two conveyance rollers 18, 19.

The controller 6 includes the likes of a ROM (Read Only Memory), a RAM (Random Access Memory), and an ASIC (Application Specific Integrated Circuit) that includes various kinds of control circuits. The controller 6 executes various kinds of processing, such as printing, on the recording sheet 100, by the ASIC, according to a program stored in the ROM. For example, in a printing processing, the controller 6 controls the likes of the ink-jet head 4 or carriage drive motor 15 to print an image or the like on the recording sheet 100, based on a printing instruction inputted from an external apparatus such as a PC. Specifically, the controller 6 causes an ink jetting operation and a conveyance operation to be alternately performed. The ink jetting operation jets ink while moving the ink-jet head 4 along with the carriage 3 in the scanning direction, and the conveyance operation conveys a certain amount of the recording sheets 100 in the conveyance direction by the conveyance rollers 18, 19.

<Details of Ink-Jet Head>

Next, a configuration of the head unit 16 of the ink-jet head 4 will be described in detail. Note that due to the four head units 16 each having the same configuration, description will be made below for one of the four head units 16.

Figure 3:
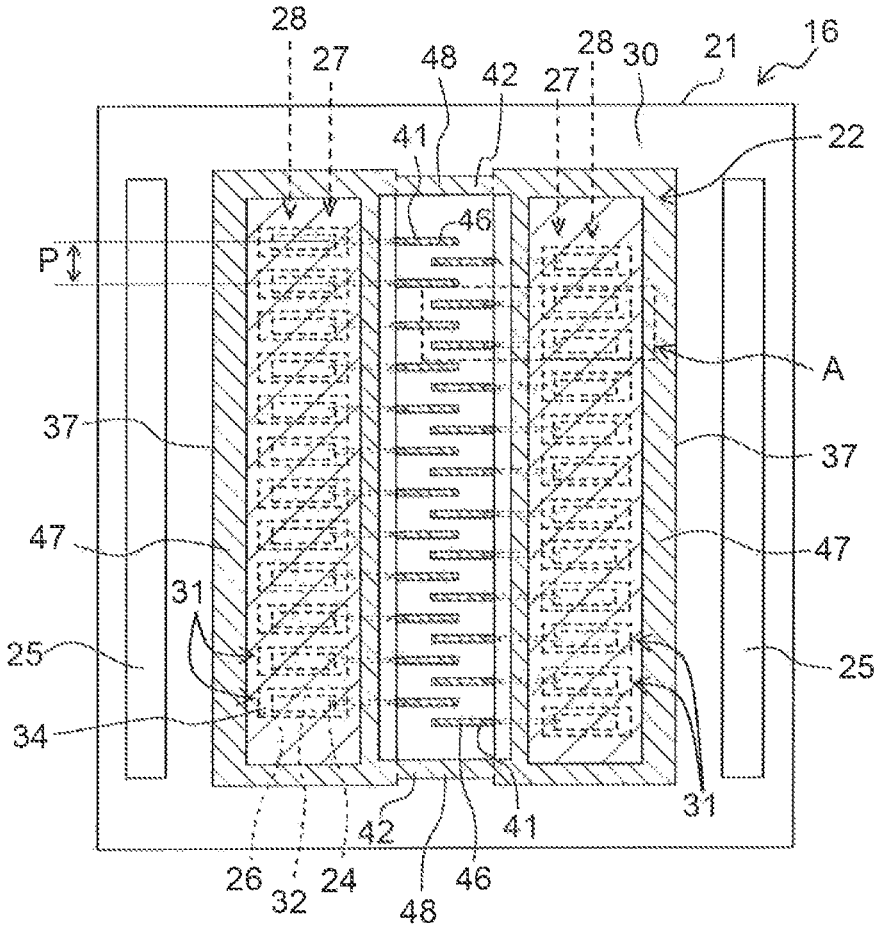
FIG. 3 is a plan view of the head unit (omitting illustration of a cover member).
Figure 4:
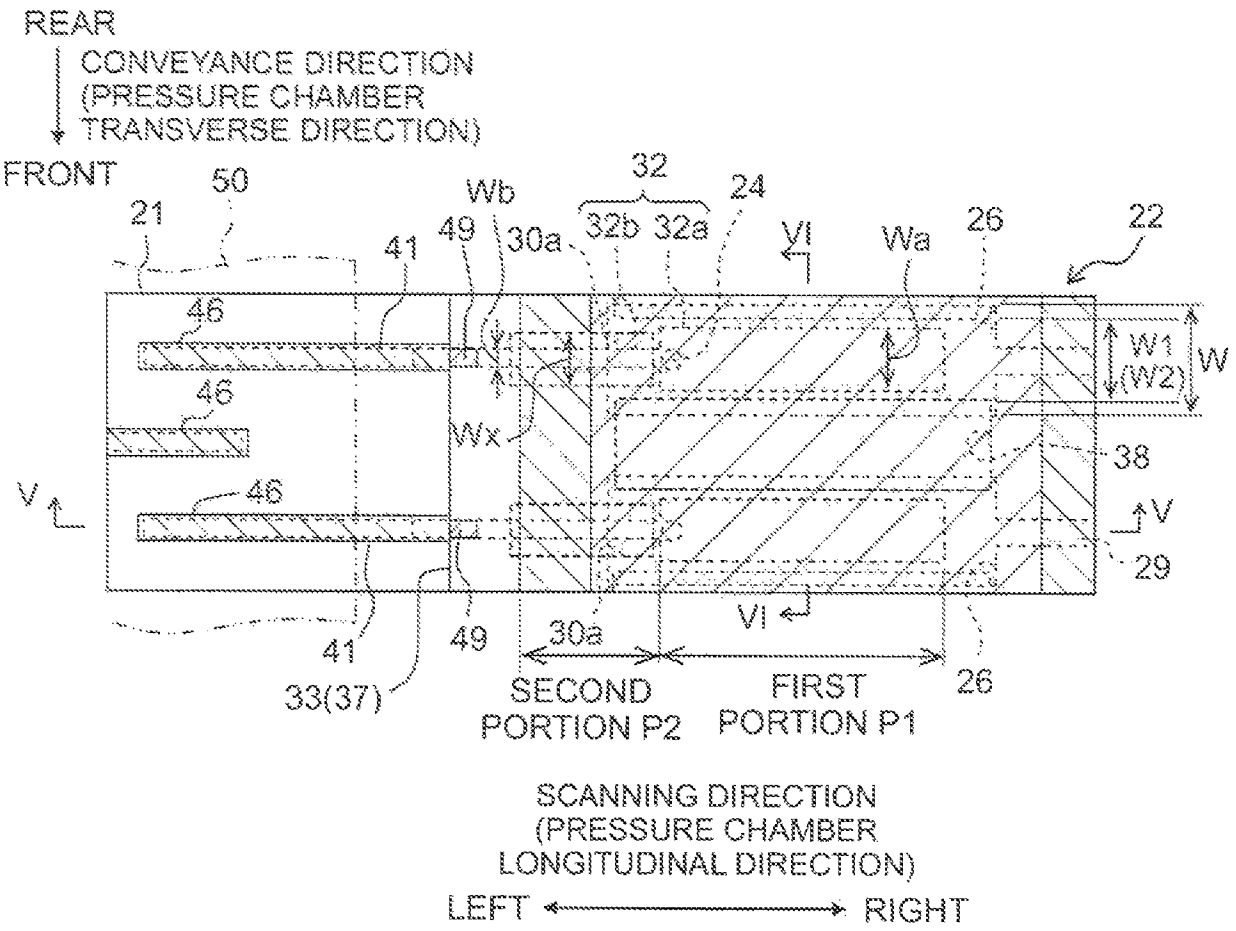
FIG. 4 is an enlarged view of section A of FIG. 3.
Figure 5:
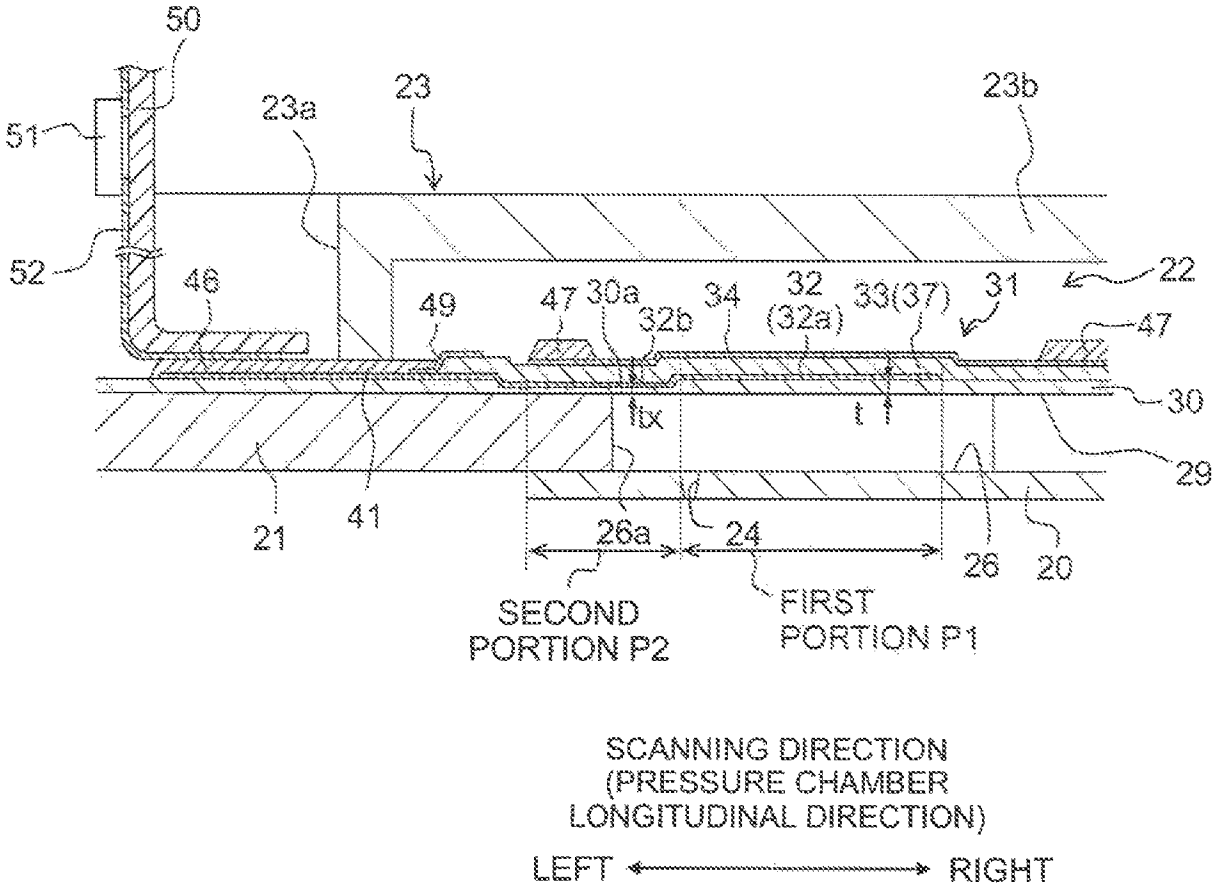
FIG. 5 is a cross-sectional view taken along the line V-V of FIG. 4.

As shown in FIGS. 2 to 6, the head unit 16 includes a nozzle plate 20, a channel substrate 21, a piezoelectric actuator 22, a COF (Chip On Film) 50, a cover member 23, and so on. Note that illustration of the COF 50 shown in FIG. 5 is omitted in FIGS. 2 and 3.

<Nozzle Plate>

The nozzle plate 20 is a plate formed by the likes of silicon, for example. This nozzle plate 20 has the plurality of nozzles 24 formed therein. As shown in FIG. 3, the plurality of nozzles 24 are arranged along the conveyance direction and configure two nozzle columns 27 aligned in the scanning direction. Moreover, when an arrangement pitch of the nozzles 24 in one nozzle column 27 is assumed to be P, positions of the nozzles 24 are misaligned by P/2 in the conveyance direction between the two nozzle columns 27.

<Channel Substrate>

The channel substrate 21 is a silicon single crystal substrate. A plurality of pressure chambers 26 respectively communicating with the plurality of nozzles 24 are formed in the channel substrate 21. Each of the pressure chambers 26 has a rectangular planar shape which is long in the scanning direction. Hereafter, the scanning direction will sometimes also be described as a "longitudinal direction (of the pressure chamber)" and the conveyance direction will sometimes also be described as a "transverse direction (of the pressure chamber)". The plurality of pressure chambers 26 are arranged according to the above-mentioned arrangement of the plurality of nozzles 24 and configure two pressure chamber columns 28 aligned in the scanning direction. A lower surface of the channel substrate 21 is covered by the nozzle plate 20. When viewed in an up-down direction, an end section on one side in the longitudinal direction of each of the pressure chambers 26 overlaps with the nozzle 24. The end section on one side in the longitudinal direction of each of the pressure chambers 26 is an end section on a central side of the head unit 16, in the scanning direction.

Figure 2:
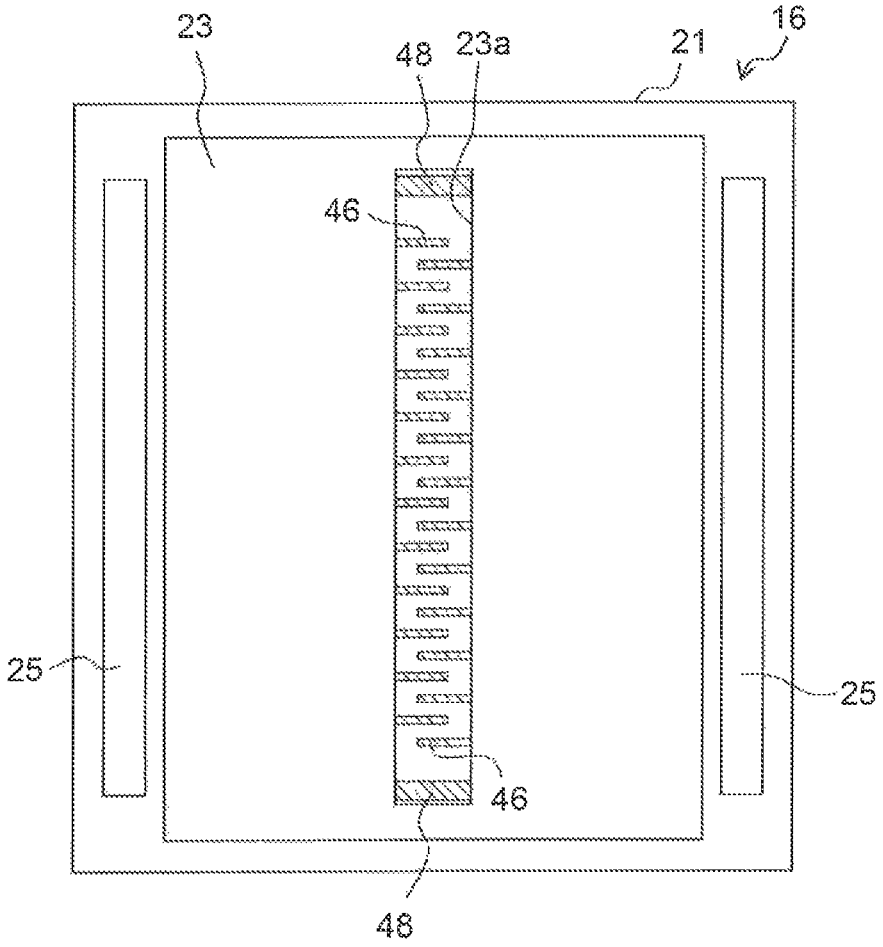
FIG. 2 is a plan view of a head unit.

As shown in FIG. 2, two manifolds 25, that extend in the conveyance direction corresponding respectively to the two pressure chamber columns 28, are formed in both of left and right end sections of the channel substrate 21. Moreover, as shown in FIGS. 4 and 5, each of the pressure chambers 26 configuring one pressure chamber column 28 are connected to their corresponding manifold 25 by a throttling channel 29 extending in the scanning direction.

Each of the manifolds 25 opens at an upper surface of the channel substrate 21. An opening of this manifold 25 is connected to the cartridge holder 7 by an ink supplying member (illustration of which is omitted) including a tube, or the like. Ink of the ink cartridge 17 of the cartridge holder 7 flows into the manifold 25 via the above-described ink supplying member, and, furthermore, is supplied from the manifold 25 to each of the pressure chambers 26 via the throttling channel 29.

<Piezoelectric Actuator>

The piezoelectric actuator 22 is a laminated body of a plurality of kinds of films including the likes of an insulating film 30, a piezoelectric element 31, an individual wiring line 41, and a common wiring line 42. This piezoelectric actuator 22 is disposed on the channel substrate 21 so as to cover the plurality of pressure chambers 26.

<Insulating Film>

Figure 6:
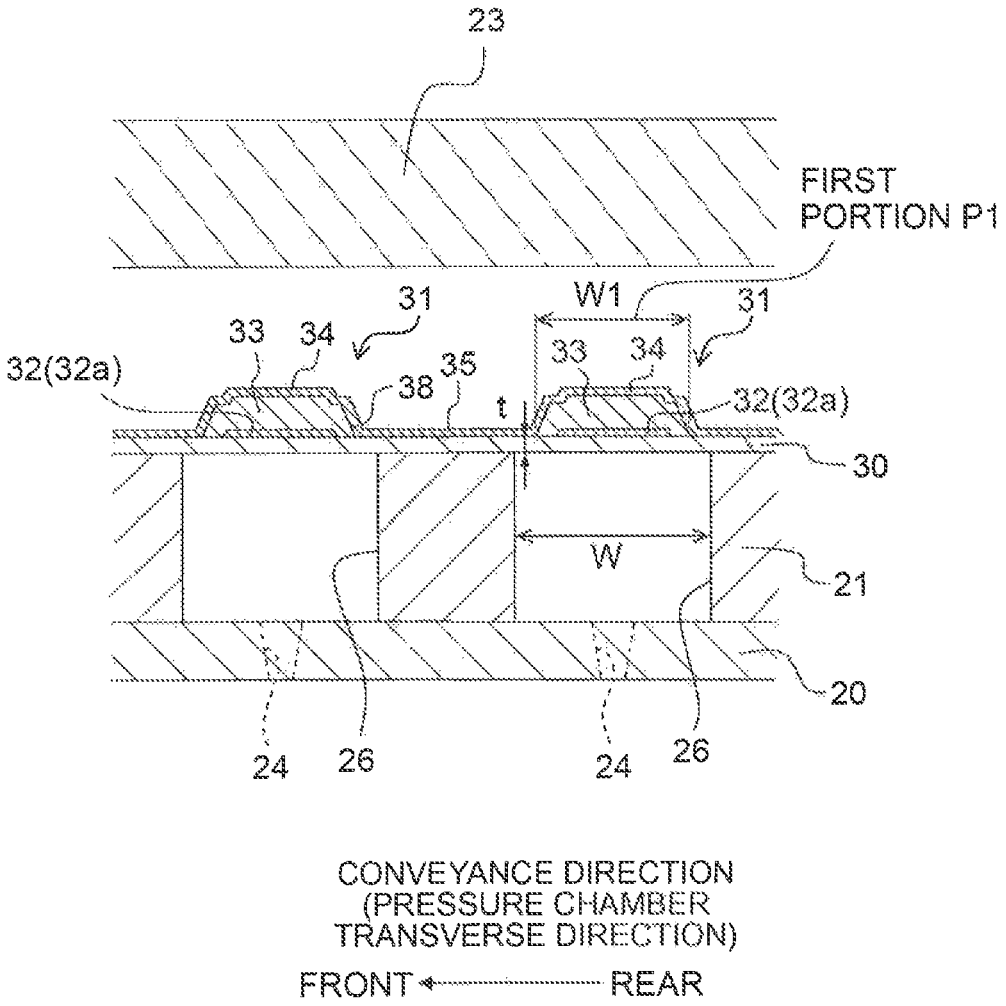
FIG. 6 is a cross-sectional view taken along the line VI-VI of FIG. 4.

As shown in FIGS. 5 and 6, the insulating film 30 covers the plurality of pressure chambers 26 formed in the channel substrate 21. The insulating film 30 of the present embodiment is a silicon dioxide film formed by oxidizing a surface of the silicon channel substrate 21, and is a film integrated with the channel substrate 21. Note that the insulating film 30 is not limited to this kind of configuration, and may be formed by another material being deposited on the surface of the channel substrate 21. Thickness of the insulating film 30 is 1.0-1.5 μm, for example.

As shown in FIG. 5, an upper surface of a portion overlapping with one of end sections 26*a* in the pressure chamber longitudinal direction, of a portion overlapping with the pressure chamber 26 of the insulating film 30, has a thin-walled portion 30*a* formed therein, by etching. The previously described one of the end sections 26*a* is the end section 26*a* more to the central side of the head unit 16 than a center of this pressure chamber 26 is in the scanning direction, and is a left end section of the pressure chamber 26 in FIG. 5. In FIG. 5, the thin-walled portion 30*a* extends from a region overlapping with the end section 26*a* of the pressure chamber 26, across a left side edge of the pressure chamber 26, and further leftwards. That is, a left end of the thin-walled portion 30*a* is closer to a left end of the channel substrate 21 than a left end of the pressure chamber 26 is. Note that as shown in FIG. 4, a width Wx in the pressure chamber transverse direction of the thin-walled portion 30*a* is smaller than a width W of the pressure chamber.

As shown in FIGS. 5 and 6, other portions of the insulating film 30, that is, portions of the insulating film 30 that overlaps with a central portion, a right end portion, and a front end portion and rear end portion which are end portions in the pressure chamber transverse direction, of the pressure chamber 26, do not have the thin-walled portion 30*a* formed therein. Particularly, the portions overlapping with the end portions in the pressure chamber transverse direction, of the insulating film 30 do not have the thin-walled portion 30*a* formed therein. In other words, a thickness tx of the thin-walled portion 30*a* is thinner than a thickness t of the other portions of the insulating film 30 including portions overlapping with the end portions in the pressure chamber transverse direction.

<Piezoelectric Element>

The plurality of piezoelectric elements 31 are respectively disposed at positions overlapping with the plurality of pressure chambers 26, of an upper surface of the insulating film 30. Each of the piezoelectric elements 31 provides jetting energy to ink in the pressure chamber 26, and jets the ink from the nozzle 24.

As shown in FIGS. 3 to 6, each of the piezoelectric elements 31 includes: a lower electrode 32 disposed on the insulating film 30; a piezoelectric film 33 disposed on the lower electrode 32; and an upper electrode 34 disposed on the piezoelectric film 33.

The lower electrode 32 is disposed in a region overlapping with the pressure chamber 26, of the upper surface of the insulating film 30. A drive signal is supplied individually from a later-mentioned driver IC 51, via the individual wiring line 41, to the lower electrode 32. That is, the lower electrode 32 is a so-called individual electrode provided individually to each pressure chamber 26. The lower electrode 32 has a wide section 32*a* and a narrow section 32*b*.

The wide section 32*a* has a rectangular shape long in the pressure chamber longitudinal direction. The wide section 32*a* is disposed overlap with the central portion of the pressure chamber 26. Note that a width Wa in the pressure chamber transverse direction of the wide section 32*a* is smaller than the width W of the pressure chamber 26.

The narrow section 32*b* is disposed in a region overlapping with the previously described one of the end portions 26*a* in the longitudinal direction of the pressure chamber 26, and is connected to the wide section 32*a*. Moreover, a width Wb in the pressure chamber transverse direction of the narrow section 32*b* is smaller than the width Wa of the wide section 32*a*. In the pressure chamber 26 of FIG. 5, the narrow section 32*b* extends leftwards from a left end section of the wide section 32*a* and crosses the left edge of the pressure chamber 26 to extend as far as a region between the two pressure chamber columns 28.

Figure 7:
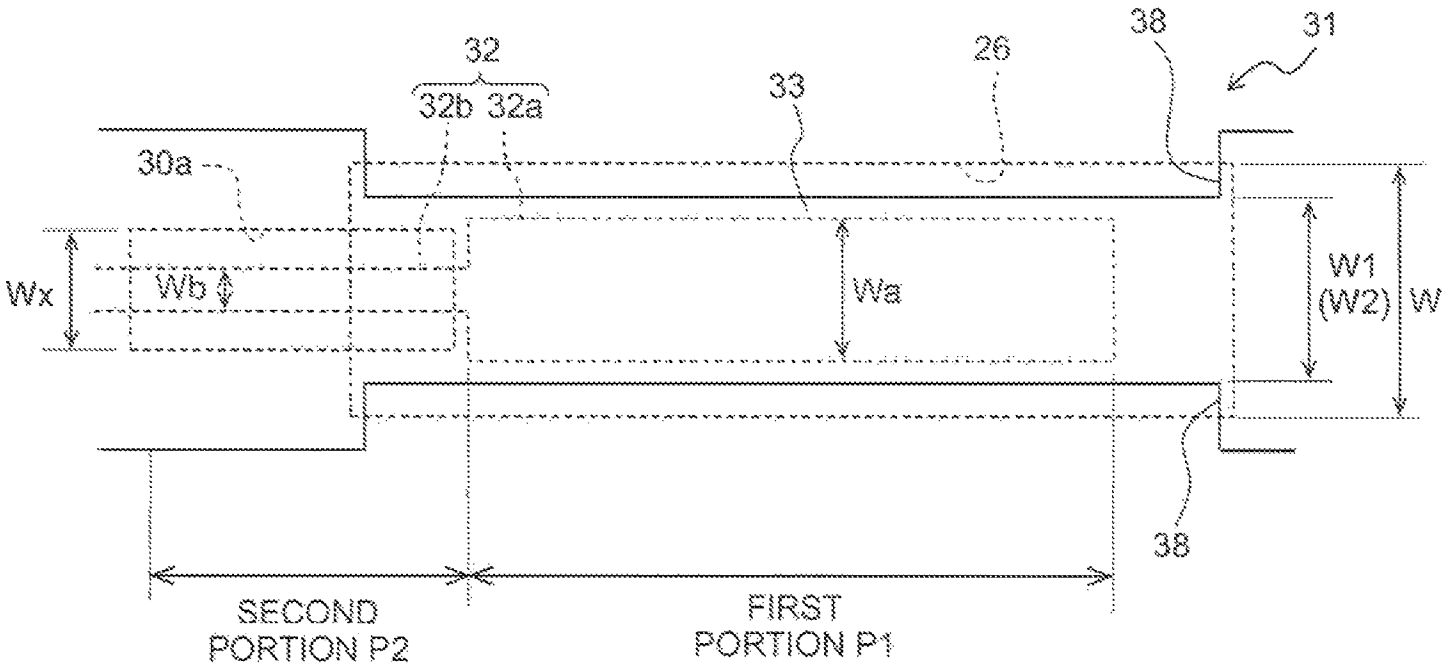
FIG. 7 is a schematic plan view of a portion overlapping with one pressure chamber of a piezoelectric actuator, and of a peripheral portion of that portion.

Moreover, as shown in FIGS. 4, 5, and 7, the narrow section 32*b* overlaps with the thin-walled portion 30*a* of the insulating film 30. Note that in the pressure chamber longitudinal direction, an end on a side close to the center of the pressure chamber 26 (a right side end in FIGS. 5 and 7), of the thin-walled portion 30*a* is positioned between a boundary position of the wide section 32*a* and narrow section 32*b* of the lower electrode 32 and an edge of the pressure chamber 26. Note that in order to make it easy to understand a disposing relationship of the pressure chamber 26, the lower electrode 32, the piezoelectric film 33, and the thin-walled portion 30*a* of the insulating film 30, illustration of the upper electrode 34 of the piezoelectric element 31 shown in FIGS. 4 to 6, is omitted in FIG. 7. The lower electrode 32 is formed by platinum (Pt), for example. Moreover, thickness of the lower electrode 32 is 0.1 μm, for example.

The piezoelectric film 33 is formed by a piezoelectric material such as lead zirconate titanate (PZT), for example. Alternatively, the piezoelectric film 33 may be formed by a non-lead-based piezoelectric material not containing lead. Thickness of the piezoelectric film 33 is 1.0-2.0 μm, for example.

As shown in FIGS. 3 and 4, in the present embodiment, the piezoelectric films 33 of a plurality of the piezoelectric elements 31 are joined in the conveyance direction to configure a rectangular shaped piezoelectric body 37 which is long in the conveyance direction. That is, two piezoelectric bodies 37 configured from piezoelectric films 33, respectively corresponding to the two pressure chamber columns 28, are disposed on the insulating film 30.

Although illustration thereof is omitted in FIG. 3, a slit 38 extending over substantially an entire length in the longitudinal direction of the pressure chamber 26 is formed in a region overlapping with a portion between adjacent two pressure chambers 26, of one piezoelectric body 37, as shown in FIGS. 4, 6, and 7. This slit 38 results in the piezoelectric film 33 being separated in the region overlapping with the portion between the two pressure chambers 26 adjacent in the conveyance direction. Moreover, when viewed in the up-down direction, one slit 38 is formed protruding into the two pressure chambers 26 positioned on both sides of it in the conveyance direction, and the slit 38 overlaps with each of the end portions in the transverse direction of the two pressure chambers 26.

A first portion P1 overlapping with the central portion of the pressure chamber 26, of the piezoelectric film 33 overlaps with the wide section 32*a* of the lower electrode 32. Moreover, since the above-described slit 38 overlaps with the end portion in the transverse direction of the pressure chamber 26, a width W1 in the pressure chamber transverse direction of the first portion P1 is smaller than the width W of the pressure chamber 26, as shown in FIGS. 4, 6, and 7. In other words, when viewed in the up-down direction, the piezoelectric film 33 is not formed on the insulating film 30 in a region between the first portion P1 of the piezoelectric film 33 and the edge of the pressure chamber 26, in the transverse direction of the pressure chamber 26.

In addition, the piezoelectric film 33 has a second portion P2 that extends from the first portion P1 across the edge of the pressure chamber 26 in one longitudinal direction of the pressure chamber 26 (a leftward direction in FIG. 5). This second portion P2 overlaps with the narrow section 32*b* of the lower electrode 32. Furthermore, the second portion P2 also overlaps with the thin-walled portion 30*a* of the insulating film 30. The second portion P2 is a portion positioned more to the left of FIG. 5 than the first portion P1, of a portion sandwiched by the lower electrode 32 and the upper electrode 34, of the piezoelectric film 33.

In other words, the lower electrode 32 having the wide section 32*a* and the narrow section 32*b* is disposed straddling the first portion P1 and the second portion P2 of the piezoelectric film 33. In the same way, the upper electrode 34 is also disposed straddling the first portion P1 and the second portion P2 of the piezoelectric film 33. As a result, the first portion P1 is sandwiched by the wide section 32*a* of the lower electrode 32 and the upper electrode 34, and the second portion P2 is sandwiched by the narrow section 32*b* of the lower electrode 32 and the upper electrode 34.

Note that as shown in FIGS. 4 and 7, a magnitude relationship in the pressure chamber transverse direction, of the width Wb of the narrow section 32*b* of the lower electrode 32, the width Wx of the thin-walled portion 30*a* of the insulating film 30, and a width W2 of a region facing the pressure chamber 26 of the second portion P2 of the piezoelectric film 33, is Wb<Wx<W2.

As shown in FIGS. 4 and 5, the narrow section 32*b* of the lower electrode 32 is exposed from a side surface of the piezoelectric body 37 to extend toward the central section in the scanning direction of the head unit 16. The later-described individual wiring line 41 is connected to this portion exposed from the piezoelectric body 37 of the narrow section 32*b*.

The upper electrode 34 is disposed in a region overlapping with the pressure chamber 26, of an upper surface of the piezoelectric film 33. The upper electrode 34 is formed by iridium, for example. Thickness of the upper electrode 34 is 0.1 μm, for example. The upper electrodes 34 of the plurality of piezoelectric elements 31 are electrically connected to each other by a conductive portion 35 formed within the slit 38.

As shown in FIGS. 3 to 5, an auxiliary conductor 47 is formed straddling the upper electrodes 34 of the plurality of piezoelectric elements 31, in an edge section of an upper surface of each of the piezoelectric bodies 37. The auxiliary conductor 47 is formed by gold (Au), for example. Moreover, thickness of the auxiliary conductor 47 is considerably thicker than that of the upper electrode 34, and is 1.0 μm, for example.

Note that as shown in FIGS. 4 and 5, a conductive section 49 formed by the same material as the upper electrode 34 is formed in an end section on a side where the narrow section 32*b* is exposed, of the piezoelectric body 37. The conductive section 49 is formed passing from the upper surface of the piezoelectric body 37 along a side surface of the piezoelectric body 37 to the narrow section 32*b*.

<Individual Wiring Line>

As shown in FIG. 5, the individual wiring line 41 is overlapped, via the conductive section 49, on a portion exposed from the piezoelectric body 37 of the narrow section 32*b*, and is electrically connected to the lower electrode 32. The individual wiring line 41 is formed by the same material as the above-mentioned auxiliary conductor 47, for example, gold (Au). Moreover, the individual wiring line 41 is thicker than the lower electrode 32, and is 1.0 μm, for example.

The individual wiring line 41 extends to a region between the two pressure chamber columns 28 along the narrow section 32*b* of the lower electrode 32. A drive contact 46 is formed in an end section of the individual wiring line 41. As shown in FIGS. 2 and 3, the drive contacts 46 of the individual wiring lines 41 extending from the piezoelectric elements 31 on the left side and the drive contacts 46 of the individual wiring lines 41 extending from the piezoelectric elements 31 on the right side, are aligned alternately in the conveyance direction between the two pressure chamber columns 28.

<Common Wiring Line>

One each of the common wiring lines 42 is respectively formed in a rear end section and a front end section of the region between the two pressure chamber columns 28. Both end sections in the scanning direction of the common wiring line 42 are respectively electrically connected to the auxiliary conductors 47 of the two piezoelectric bodies 37. Moreover, a central portion of the common wiring line 42 represents a ground contact 48 connected to the COF 50.

<COF>

As shown in FIGS. 2 to 5, a central portion in the scanning direction of the channel substrate 21 where the plurality of drive contacts 46 and the two ground contacts 48 are disposed, has one end section of the COF 50 joined thereto. The driver IC 51 is mounted on a middle section of the COF 50. Moreover, although illustration thereof is omitted, the other end section of the COF 50 is connected to the controller 6 (refer to FIG. 1) of the printer 1. A plurality of wiring lines 52 connected to the driver IC 51 and a ground wiring line (illustration of which is omitted) are formed on the COF 50. When the COF 50 is joined to the channel substrate 21, end sections of the plurality of wiring lines 52 of the COF 50 are respectively electrically connected to the plurality of drive contacts 46. Moreover, the ground wiring line of the COF 50 is electrically connected to the ground contact 48.

The driver IC 51 generates a drive signal based on a control signal from the controller 6, and outputs the drive signal to each of the piezoelectric elements 31. The drive signal is inputted to the drive contact 46 via the wiring line 52, and, furthermore, is supplied to the corresponding lower electrode 32 via the individual wiring line 41. At this time, a potential of the lower electrode 32 changes between a certain drive potential and a ground potential. On the other hand, the plurality of upper electrodes 34 connected to the ground contact 48 by the common wiring line 42 are commonly provided with a ground potential.

<Cover Member>

The cover member 23 is provided for protecting the plurality of piezoelectric elements 31 and is joined by an adhesive agent to an upper surface of the insulating film 30. As shown in FIGS. 2 and 5, the cover member 23 includes: an opening section 23*a* formed in a central section in the scanning direction of the cover member 23; and two cover sections 23*b* provided on both of left and right sides of the opening section 23*a*. The plurality of drive contacts 46 and the two ground contacts 48 of the piezoelectric actuator 22 are exposed from the opening section 23*a* of the cover member 23. The COF 50 passes through the opening section 23*a* to be joined to a disposing region of the contacts 46, 48. The two left and right cover sections 23*b* respectively cover the two piezoelectric bodies 37. Note that as shown in FIG. 2, openings of the manifolds 25 respectively formed in both of left and right end sections of the channel substrate 21 are each exposed from the cover member 23 and connected to the unillustrated ink supplying member.

Next, operation of the piezoelectric actuator 22 when the drive signal is supplied from the driver IC 51 will be described with reference to FIG. 8.

The first portion P1 disposed in the central portion of the pressure chamber 26, of the piezoelectric film 33 is sandwiched by the wide section 32*a* of the lower electrode 32 and the upper electrode 34. In a state where the drive signal is not being inputted, the potential of the lower electrode 32 is the ground potential and is the same potential as the upper electrode 34. When the drive signal is inputted to the lower electrode 32 from this state, an electric field in a thickness direction acts in the first portion P1, due to a potential difference from the upper electrode 34. At this time, the first portion P1 contracts in a surface direction due to an inverse piezoelectric effect.

Moreover, in the region overlapping with the central portion of the pressure chamber 26, a neutral surface C of the piezoelectric actuator 22 is more to a pressure chamber 26 side than a central position D in a thickness direction of the piezoelectric film 33 is. Note that a neutral surface C of the piezoelectric actuator 22 refers to a surface where stress is zero even when bending has acted, in an entirety of a laminated body of a plurality of kinds of films configuring the actuator 22. Extension and contraction due to bending does not occur in a portion positioned in this neutral surface C. For example, in FIG. 8, in the central portion of the pressure chamber 26, the neutral surface C of the piezoelectric actuator 22 will be a neutral surface of a laminated body configured from the insulating film 30, the wide section 32*a* of the lower electrode 32, the first portion P1 of the piezoelectric film 33, and the upper electrode 34. Note that in FIG. 8, the neutral surface C is shown at substantially a central position in the thickness direction of the entire laminated body configuring the piezoelectric actuator 22. However, in reality, a position of the neutral surface C changes according to thicknesses or Young's moduli of the respective films configuring the laminated body, and is not limited to a central position in the thickness direction of the laminated body.

Figure 8:
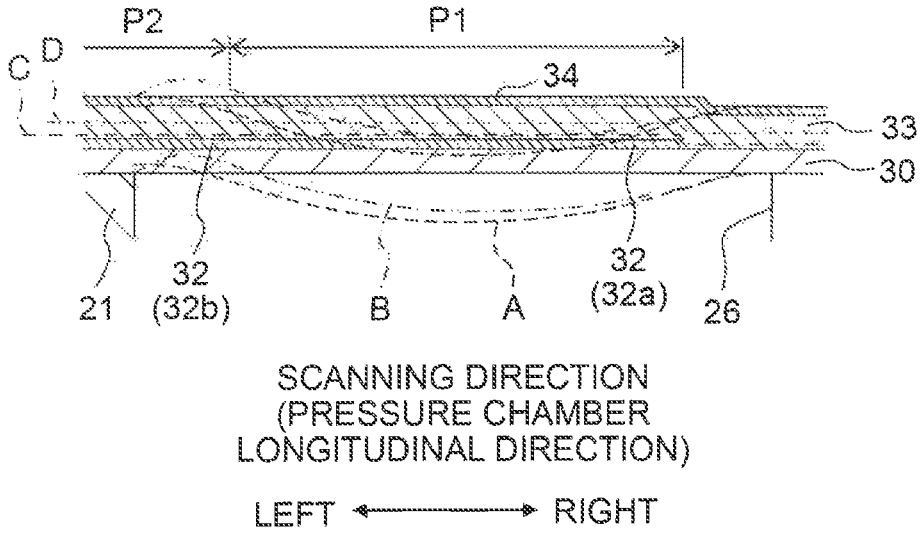
FIG. 8 is a cross-sectional view of the piezoelectric actuator showing behavior during drive of a piezoelectric element.

As shown by the broken line A of FIG. 8, when the first portion P1 contracts in the surface direction in this configuration, an entire portion overlapping with the pressure chamber 26 of the piezoelectric actuator 22 bends convexly toward the pressure chamber 26. As a result, capacity of the pressure chamber 26 decreases, whereby a pressure wave occurs in the pressure chamber 26 and a droplet of ink is jetted from the nozzle 24 communicating with the pressure chamber 26.

Incidentally, in the present embodiment, the second portion P2 of the piezoelectric film 33 in a position overlapping with one end portion in the longitudinal direction of the pressure chamber 26 is also sandwiched by the narrow section 32*b* of the lower electrode 32 and the upper electrode 34. Therefore, when the drive signal is applied to the lower electrode 32, contraction occurs also in this second portion P2.

Now, the piezoelectric actuator 22 has its deformation constrained in a portion thereof positioned more to an outer side of the pressure chamber 26 than the edge of the pressure chamber 26. Therefore, as shown by the two dot-chain line B of FIG. 8, when contraction has occurred in the second portion P2 overlapping with one end portion in the longitudinal direction of the pressure chamber 26, a portion including the second portion P2 of the piezoelectric actuator 22 bends convexly to an opposite side to the pressure chamber 26, differently from the portion P1. As a result, a displacement amount in a downward direction of the actuator 22 in the pressure chamber central portion decreases, and jetting energy provided to the ink by a single time of drive of the piezoelectric element 31 lowers.

Therefore, in order to suppress lowering of the displacement amount of the piezoelectric actuator 22 at a position overlapping with the central portion of the pressure chamber 26, it becomes important to reduce bending of the portion including the second portion P2 of the actuator 22. Now, regarding bending of the piezoelectric actuator 22, the further the portion that contracts by receiving the electric field is separated in the thickness direction from the neutral surface C of the entire actuator, the larger the bending of the piezoelectric actuator 22 becomes. In a portion that is actively desired to be bent, that is, the portion overlapping with the central portion of the pressure chamber 26, the neutral surface C of the piezoelectric actuator 22 is preferably separated from the central position D in the thickness direction of the piezoelectric film 33. However, in a portion whose bending is desired to be suppressed, that is the portion overlapping with the end portion in the longitudinal direction of the pressure chamber 26, the neutral surface C of the piezoelectric actuator 22 is preferably brought close to the central position D in the thickness direction of the piezoelectric film 33.

In order to change the position of the neutral surface C in one portion of the piezoelectric actuator 22, all that is required is to change thickness of the film configuring that one portion. Accordingly, in the present embodiment, the thin-walled portion 30*a* is formed in the portion overlapping with the second portion P2, of the insulating film 30.

Figure 9:
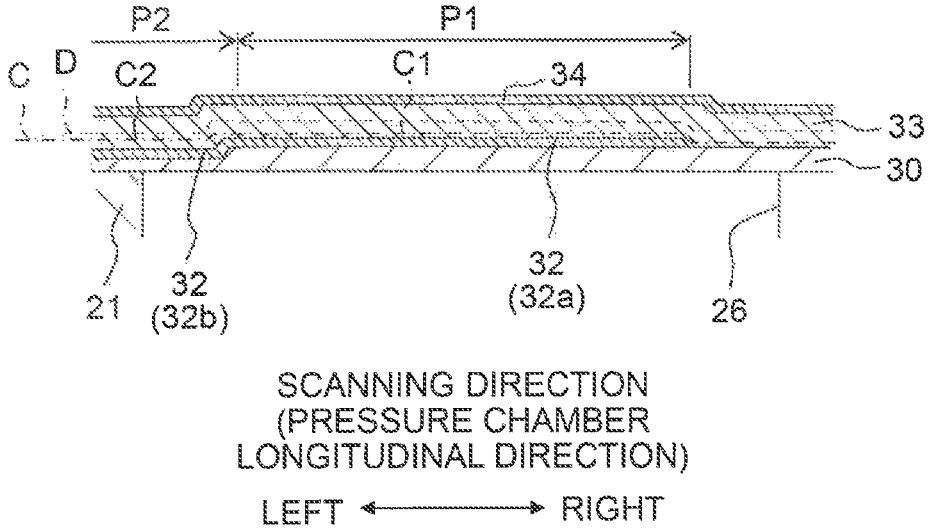
FIG. 9 is a cross-sectional view of the piezoelectric actuator showing neutral surfaces of the piezoelectric film and the piezoelectric actuator when a thin-walled portion is formed in an insulating film.
Figure 10A:
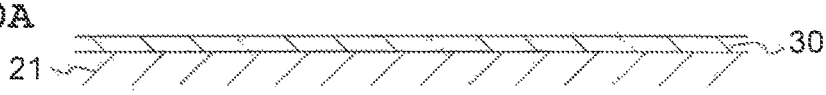
FIGS. 10A to 10J are views showing manufacturing steps of the head unit.
Figure 10B:
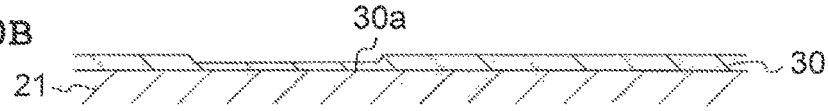
Figure 10C:
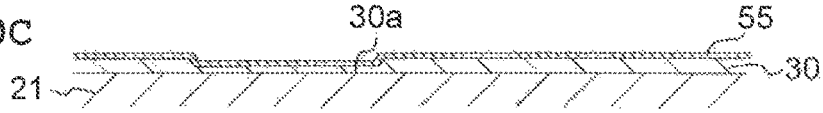
Figure 10D:
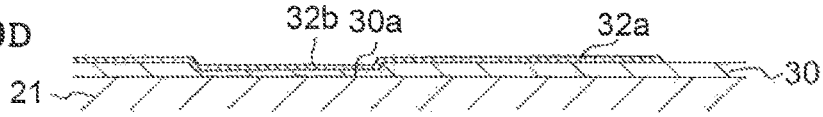
Figure 10E:
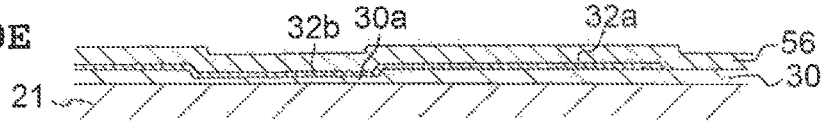
Figure 10F:
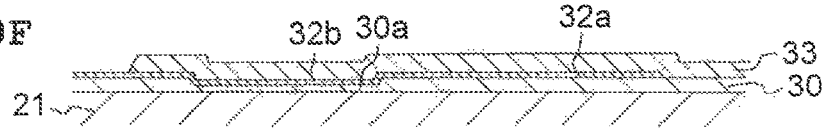
Figure 10G:
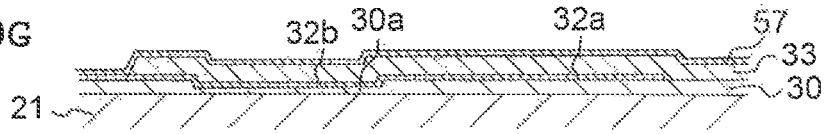
Figure 10H:
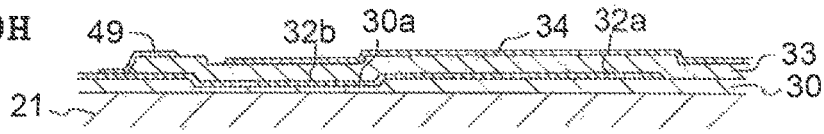
Figure 10I:
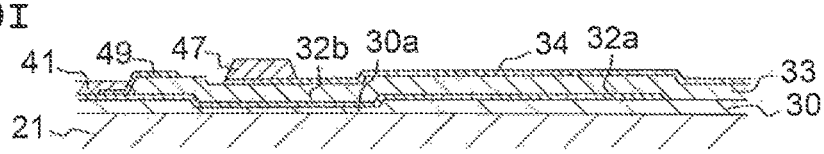
Figure 10J:
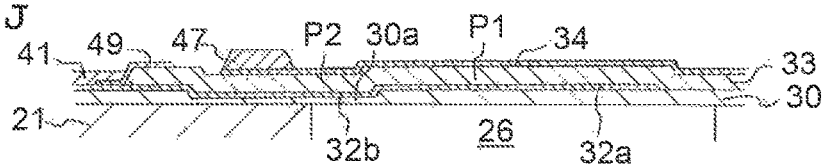

As shown in FIG. 9, the thin-walled portion 30*a* is formed in the portion overlapping with the second portion P2, of the insulating film 30. That is, in a portion overlapping with the left end portion of the pressure chamber 26, of the insulating film 30, thickness is thinner compared to in other portions.

Therefore, a neutral surface C2 in the portion including the second portion P2, of the piezoelectric actuator 22 is closer to the central position D in the thickness direction of the piezoelectric film 33 compared to a neutral surface C1 in the portion including the first portion P1, or the piezoelectric actuator 22. Therefore, even if contraction occurs in the second portion P2 sandwiched by the narrow section 32*b* and the upper electrode 34, in one end portion in the longitudinal direction of the pressure chamber 26, bending of the actuator 22 due to this contraction is reduced.

Note that the thin-walled portion 30*a* preferably overlaps with an entire region of the portion where contraction particularly occurs, of the second portion P2. From this viewpoint, as shown in FIG. 5, it is preferable that the thin-walled portion 30*a* is formed to the edge of the pressure chamber 26 and that, as shown in FIG. 7, the width Wx of the thin-walled portion 30*a* is broader than the width Wb of the narrow section 32*b*.

On the other hand, the thickness tx of the thin-walled portion 30*a* of the insulating film 30 is thinner than the thickness t of the other portions where the thin-walled portion 30*a* is not formed, of the insulating film 30. In particular, it is thinner than the thickness t (refer to FIG. 6) of a portion, of the insulating film 30, which is positioned outside the first portion P1 and inside the pressure chamber 26 in relation to the pressure chamber transverse direction. Conversely expressed, an uncovered portion, of the insulating film 30, which is not covered by the piezoelectric film 33 and which is positioned closer to the edge of the pressure chamber 26 than the first portion P1 is in the pressure chamber transverse direction, is not thinned. Therefore, damage of the insulating film 30 in the above-described uncovered portion is prevented.

As shown in FIG. 9, the neutral surface C1 of the portion including the first portion P1, of the piezoelectric actuator 22 is closer to the pressure chamber 26 than the central position D in the thickness direction of the piezoelectric film 33 is. In this configuration, the piezoelectric actuator 22 bends to the pressure chamber 26 side due to contraction of the first portion P1. On the other hand, the neutral surface C2 of the portion including the second portion P2, of the piezoelectric actuator 22 is closer to the central position D in the thickness direction of the pressure chamber 33 than the neutral surface C1 is. As a result, bending to an opposite side to the pressure chamber 26 of the piezoelectric actuator 22 due to contraction of the second portion P2, is suppressed.

Note that from a viewpoint of suppressing bending of the piezoelectric actuator 22 due to contraction of the second portion P2, all that is required is that an end on a central side of the pressure chamber 26, of the thin-walled portion 30*a* is positioned in a boundary position of the wide section 32*a* and the narrow section 32*b* of the lower electrode 32. However, although brief mention thereof will be made also later, in manufacturing steps of the piezoelectric actuator 22, if a target position of the end of the thin-walled portion 30*a* is set to the boundary position of the wide section 32*a* and the narrow section 32*b*, positions of the lower electrode 32 and the thin-walled portion 30*a* of the insulating film 30 are only a little misaligned, hence part of the thin-walled portion 30*a* overlaps with the wide section 32*a*, that is, the first portion P1. As a result, the neutral surface C1 of the actuator 22 in the portion including the first portion P1 gets closer to the central position D in the thickness direction of the piezoelectric film 33, and displacement lowers.

Accordingly, in the present embodiment, as shown in FIGS. 4, 5, and 7, the right end of the thin-walled portion 30*a* is positioned more to the left than the boundary position of the wide section 32*a* and the narrow section 32*b*. Therefore, even if some positional misalignment occurs between the lower electrode 32 and the thin-walled portion 30*a* at a manufacturing stage, the thin-walled portion 30*a* does not overlap with the wide section 32*a*.

From a viewpoint of effectively suppressing bending of the piezoelectric actuator 22 in the portion including the second portion P2, the thin-walled portion 30*a* is preferably formed in an entire region of the region overlapping with the second portion P2 in the pressure chamber longitudinal direction, that is, as far as a left edge of the pressure chamber 26 in FIG. 5. However, when positional misalignment has occurred between the pressure chamber 26 and the thin-walled portion 30*a* during manufacturing, there is a possibility that the position of the thin-walled portion 30*a* is misaligned to the central side of the pressure chamber 26, with respect to the edge of the pressure chamber 26. Accordingly, in the present embodiment, as shown in FIG. 5, the thin-walled portion 30*a* extends beyond the edge of the pressure chamber 26 from the region overlapping with the pressure chamber 26. The left end of the thin-walled portion 30*a* is in a position closer to a central section in the scanning direction of the channel substrate 21 than the left edge of the pressure chamber 26 is. In this configuration, even if the position with respect to the pressure chamber 26 of the thin-walled portion 30*a* is somewhat misaligned, the left end of the thin-walled portion 30*a* never overlaps with the pressure chamber 26.

Next, manufacturing steps of the above-mentioned head unit 16 will be described. Manufacturing steps of the piezoelectric actuator will mainly be described here. Note that entries (a) to (j) below respectively correspond to FIGS. 10A to 10J.

(a) The insulating film 30 is formed, by a method such as thermal oxidation, on a surface of a silicon single crystal substrate that will be the channel substrate 21.

(b) The thin-walled portion 30*a* is formed, by etching, in a portion that will overlap with one end portion in the longitudinal direction of the pressure chamber 26 when the pressure chamber 26 has been later formed, of the insulating film 30. This thin-walled portion 30*a* is formed only in one end portion in the pressure chamber longitudinal direction. In other words, thickness of the thin-walled portion 30*a* is thinner than that of portions overlapping with the end portions in the transverse direction of the pressure chamber 26.

(c) A conductive film 55 for the lower electrode 32 is formed on the insulating film 30 by sputtering or the like.

(d) The conductive film 55 undergoes patterning by etching, and the lower electrode 32 having the wide section 32*a* and the narrow section 32*b* is formed.

(e) A film 56 of a piezoelectric material is deposited, by the likes of sol-gel or sputtering, on the insulating film 30 where the lower electrode 32 has been formed.

(f) The film 56 of the piezoelectric material undergoes patterning by etching, whereby the piezoelectric film 33 is formed. The piezoelectric film 33 formed at this time includes: the first portion P1 that will overlap with the central portion of the pressure chamber 26; and the second portion P2 that extends in a direction that the thin-walled portion 30*a* is disposed with respect to the first portion P1 and that further extends from the first portion P1 to a position that will exceed the edge of the pressure chamber 26. Therefore, the second portion P2 overlaps with the thin-walled portion 30*a* of the insulating film 30.

During the above-described patterning, the slit 38 is formed between where the pressure chambers 26 will be adjacent in the conveyance direction. Note that the slit 38 crosses what will be front and rear edges of the pressure chamber 26, whereby part of the slit 38 is formed as far as a region that will overlap with the pressure chamber 26. As a result, the insulating film 30 is exposed from the piezoelectric film 33 in a region close to what will be the edge of the pressure chamber 26. Note that when the slit 38 is formed in the film 56 by etching, there is a possibility that in a region closer to what will be the edge of the pressure chamber 26 than the first portion P1 is in the pressure chamber transverse direction, the insulating film 30 is shaved along with the film 56, whereby thickness of the insulating film 30 is thinned. However, even in that case, thickness of the insulating film 30 is never excessively thinned in the region closer to what will be the edge of the pressure chamber 26 than the first portion P1 is, because in the above-described step (b), the thin-walled portion 30*a* is formed only in the one end portion in the pressure chamber longitudinal direction. Note that etching conditions, and so on, are preferably set so as to prevent the above-described portion not overlapping with the piezoelectric film 33, of the insulating film 30 from becoming thinner than the thin-walled portion 30*a*, even if the insulating film 30 has become a little thinned during formation of the slit 38.

(g) A conductive film 57 for the upper electrode 34 is formed on the piezoelectric film 33 by sputtering or the like.

(h) The conductive film 57 undergoes patterning by etching, and the upper electrode 34 and conductive section 49 are formed.

(i) The individual wiring line 41 is formed, by plating, on the narrow section 32*b* of the lower electrode 32. The auxiliary conductor 47 is formed on the upper electrode 34, in the same way by plating. As a result of the above, manufacturing of the piezoelectric actuator 22 is completed.

(j) Etching is performed on the channel substrate 21 from a surface on an opposite side to the piezoelectric actuator 22, and the pressure chamber 26 is formed.

Note that although also briefly mentioned previously, positional misalignment may occur between the thin wall portion 30*a* and the lower electrode 32 and pressure chamber 26 due to manufacturing tolerances in each of steps of formation of the thin-walled portion 30*a* in (c), patterning of the lower electrode 32 in (d), and formation of the pressure chamber 26 in (j).

However, by the end section on the central side of the pressure chamber 26, of the thin-walled portion 30*a* being disposed in a position more to the left than the boundary position of the wide section 32*a* and the narrow section 32*b* of the lower electrode 32, that is, in a position to one side in the pressure chamber longitudinal direction, the thin-walled portion 30*a* is prevented from overlapping with the wide section 32*a*. Moreover, by another end section of the thin-walled portion 30*a* being disposed in a position not overlapping with the pressure chamber 26 exceeding the left edge of the pressure chamber 26, it is also prevented that the left end of the thin-walled portion 30*a* overlaps with the pressure chamber 26 without crossing the edge of the pressure chamber 26.

In the embodiment described above, the head unit 16 corresponds to a "liquid jetting apparatus" of the present teaching. The lower electrode 32 corresponds to a "first electrode" of the present teaching. The upper electrode 34 corresponds to a "second electrode" of the present teaching. The wide section 32*a* of the lower electrode 32 corresponds to a "first portion electrode" of the present teaching, and the narrow section 32*b* of the lower electrode 32 corresponds to a "second portion electrode" of the present teaching. The neutral surface C1 of the portion including the first portion P1 of the piezoelectric actuator 22 corresponds to a "first neutral surface" of the present teaching, and the neutral surface C2 of the portion including the second portion P2 of the piezoelectric actuator 22 corresponds to a "second neutral surface" of the present teaching. The pressure chamber longitudinal direction corresponds to a "first direction" of the present teaching, and the pressure chamber transverse direction corresponds to a "second direction" of the present teaching.

Next, modified examples where various changes have been made to the previously described embodiment will be described. However, configurations of the modified examples similar to those of the previously described embodiment will be assigned with the same symbols as those assigned in the previously described embodiment, and descriptions thereof will be appropriately omitted.

Figure 11:
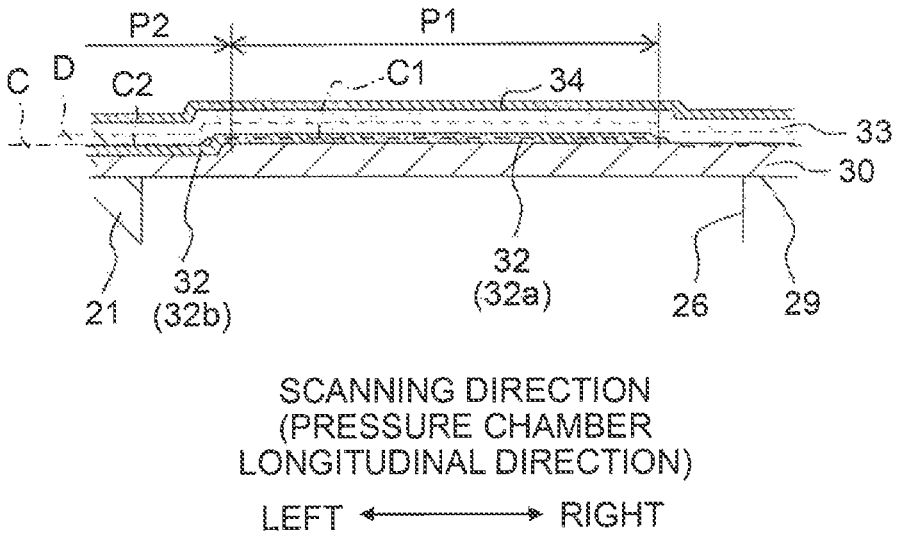
FIG. 11 is a cross-sectional view taken along a pressure chamber transverse direction, of a piezoelectric actuator of a first modified example.

FIG. 9 of the previously described embodiment described a configuration where the neutral surface C1 of the portion including the first portion P1 of the piezoelectric actuator 22 was closer to the pressure chamber 26 than the central position D in the thickness direction of the piezoelectric film 33 was. In this regard, there may further be a configuration in which, as in FIG. 11, the above-described neutral surface C1 is closer to the pressure chamber 26 than a lower surface of the piezoelectric film 33, that is, a surface facing the insulating film 30 of the piezoelectric film 33 is (first modified example). Because the neutral surface C1 is further separated from the central position D in the thickness direction of the piezoelectric film 33, bending in a downward direction of the piezoelectric actuator 22 in the central portion of the pressure chamber 26 when the first portion P1 has contracted in the surface direction, becomes even larger.

Figure 12:
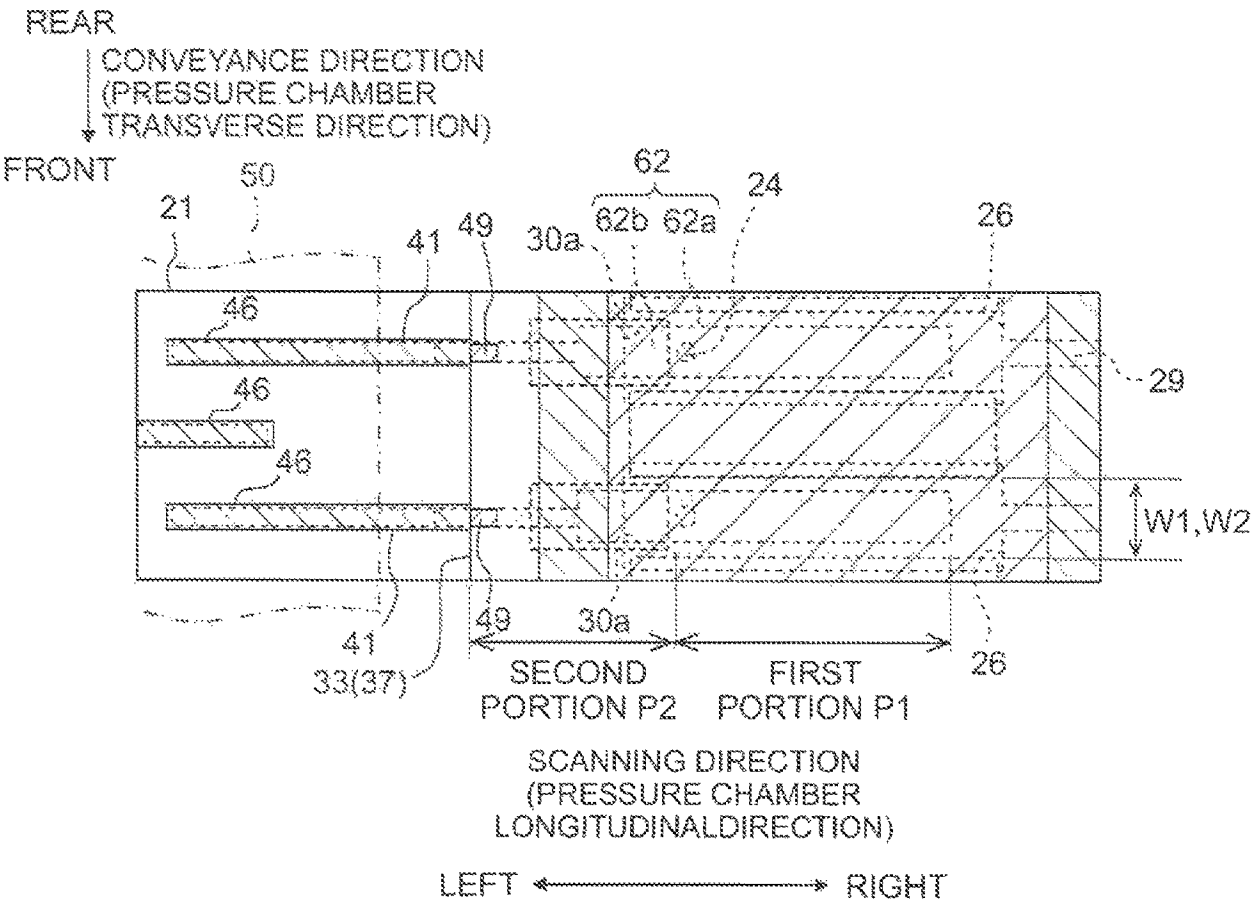
FIG. 12 is a cross-sectional view taken along a pressure chamber longitudinal direction, of a piezoelectric actuator of a second modified example.

In the previously described embodiment, the width of the lower electrode 32 changes at a position overlapping with the pressure chamber 26. In other words, the boundary of the wide section 32*a* and the narrow section 32*b* exists in a position overlapping with the pressure chamber 26. In contrast, as shown in FIG. 12, a width of a portion 62*a* overlapping with the central portion of the pressure chamber 26 may be the same as a width of a portion 62*b* overlapping with one end portion in the pressure chamber longitudinal direction, and a width of a lower electrode 62 may change at a position not overlapping with the pressure chamber 26 (second modified example).

Figure 13:
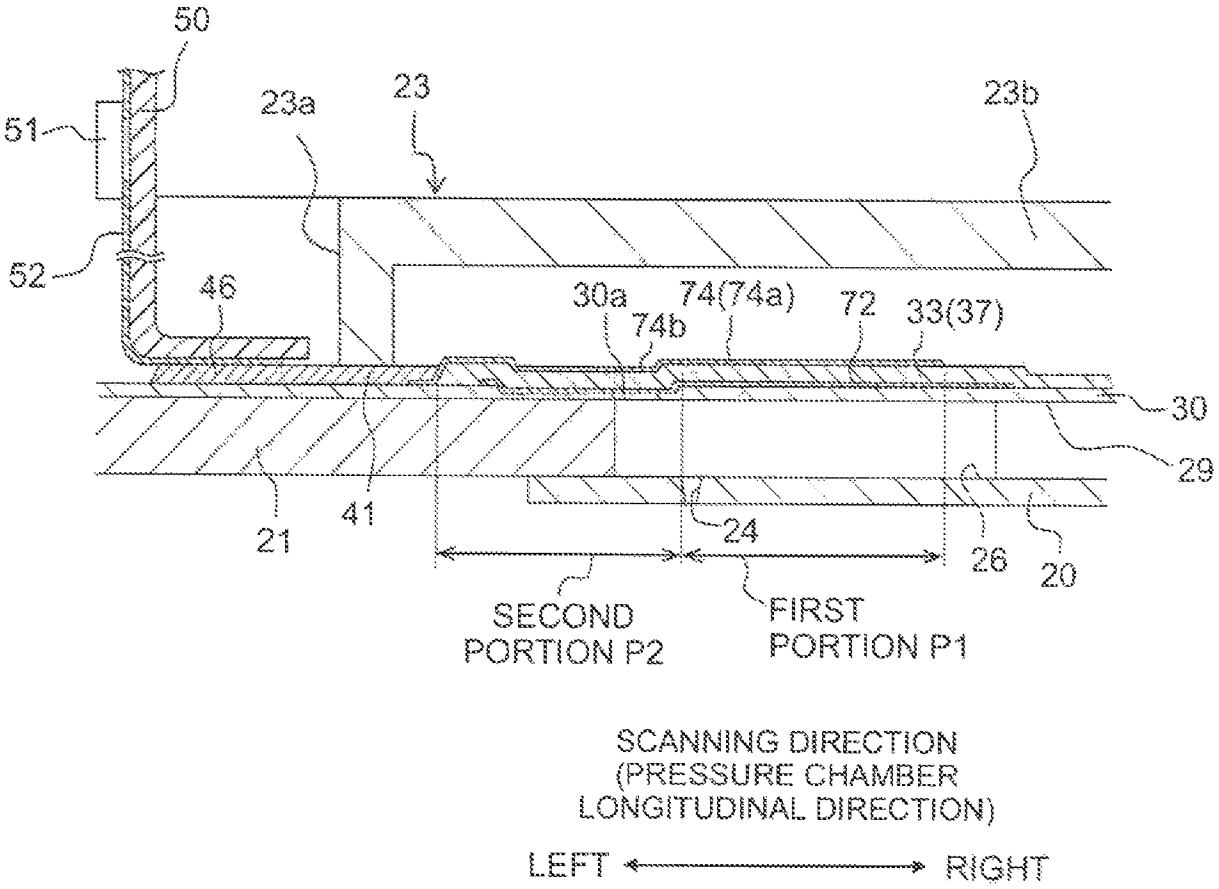
FIG. 13 is a cross-sectional view taken along the pressure chamber longitudinal direction, of a piezoelectric actuator of a third modified example.

In the previously described embodiment, the lower electrode 32 was a so-called individual electrode, connected to the drive contact 46 to be supplied with a drive signal. However, the upper electrode may be an individual electrode (third modified example). For example, in FIG. 13, an upper electrode 74 includes: a wide section 74*a* overlapping with the central portion of the pressure chamber 26; and a narrow section 74*b* that extends to one side in the pressure chamber longitudinal direction from the wide section 74*a* and whose width is smaller than that of the wide section 74*a*. The narrow section 74*b* further extends to a region not overlapping with the pressure chamber 26 and is connected to the individual wiring line 41. On the other hand, a lower electrode 72 is an electrode connected to the ground contact 47 (refer to FIG. 3).

In this mode, a portion overlapping with the wide section 74*a* of the upper electrode 74, of the piezoelectric film 33 will be the first portion P1, and a portion overlapping with the narrow section 74*b* of the upper electrode 74, of the piezoelectric film 33 will be the second portion P2. Moreover, the thin-walled portion 30*a* is formed in the portion overlapping with the second portion P2 of the insulating film 30.

In the previously described embodiment, part (the narrow section 32*b*) of the lower electrode 32 which is the individual electrode is disposed in a region overlapping with one end portion in the longitudinal direction of the pressure chamber 26. However, the individual wiring line connected to the individual electrode may be disposed to overlap with one end portion in the longitudinal direction of the pressure chamber 26 (fourth modified example).

Figure 14:
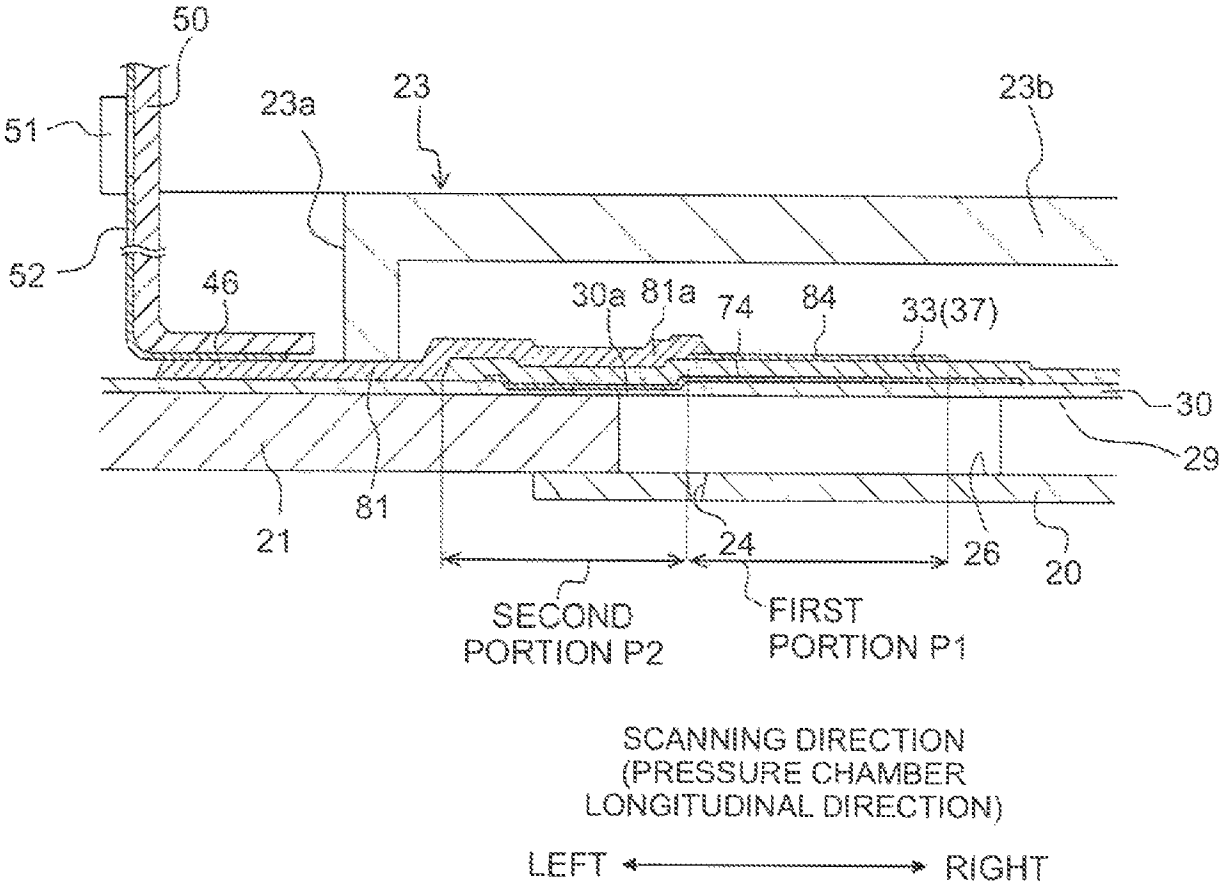
FIG. 14 is a cross-sectional view taken along the pressure chamber longitudinal direction, of a piezoelectric actuator of a fourth modified example.

For example, in FIG. 14, an individual wiring line 81 formed so as to ride up onto the upper surface of the piezoelectric film 33 is connected to an upper electrode 84 disposed in the central portion of the pressure chamber 26. In this mode, an end section 81*a* of the individual wiring line 81 is disposed to overlap with an end portion on one side in the longitudinal direction of the pressure chamber 26. That is, a portion overlapping with the upper electrode 84, of the piezoelectric film 33 will be the first portion P1, and a portion where the end section 81*a* of the individual wiring line 81 is disposed will be the second portion P2. Moreover, the thin-walled portion 30*a* is formed in the portion overlapping with the second portion P2 of the insulating film 30.

Note that even in the mode of FIG. 14, in order to suppress effects of positional misalignment of the thin-walled portion 30*a*, and so on, the end section on the central side of the pressure chamber 26 in the pressure chamber longitudinal direction, of the thin-walled portion 30*a* is preferably further from the center of the pressure chamber 26 than a connection position of the upper electrode 84 and the end section 81*a* of the individual wiring line 81 is, similarly to in the previously described embodiment.

In the previously described embodiment, the thin-walled portion 30*a* is formed in the upper surface of the insulating film 30 by etching. However, the thin-walled portion 30*a* may be formed in a lower surface facing the pressure chamber 26, of the insulating film 30, by etching. In this case, etching of the thin-walled portion 30*a* is performed after the step of formation of the pressure chamber 26.

A shape of the thin-walled portion 30*a* is not particularly limited. For example, in the previously described embodiment, as shown in FIG. 4, a plurality of the thin-walled portions 30*a* respectively corresponding to the plurality of pressure chambers 26, are formed. However, the plurality of thin-walled portions 30*a* respectively corresponding to the plurality of pressure chambers 26 may be joined in the conveyance direction.

Figure 15A:
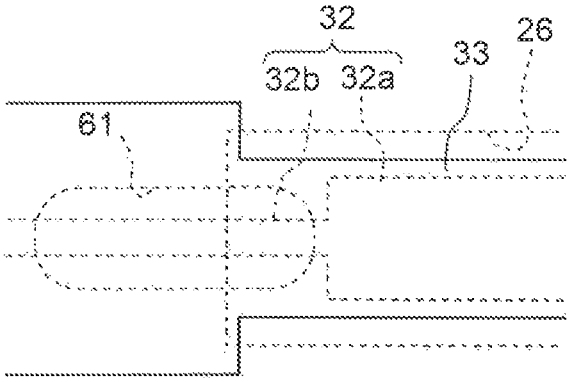
FIGS. 15A and 15B are plan views corresponding to FIG. 7, of piezoelectric actuators of, respectively, fifth and sixth modified examples.

A planar shape of the thin-walled portion is not limited to being a rectangular shape (fifth modified example). For example, as in FIG. 15A, a thin-walled portion 61 may have an elliptical shape which is long in the left-right direction.

Figure 15B:
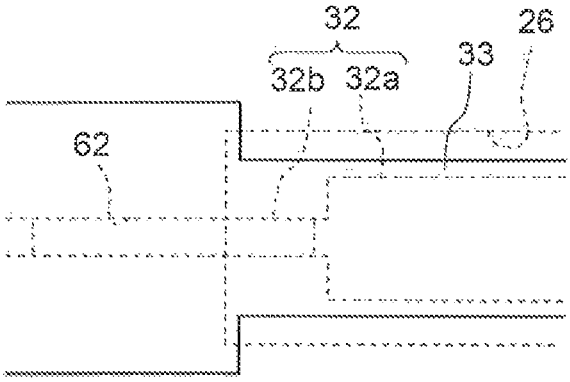

Moreover, in the previously described embodiment, width of the thin-walled portion 30*a* is larger than that of the narrow section 32*b* of the lower electrode 32 (refer to FIG. 7). However, as in FIG. 15B, width of a thin-walled portion 62 may be the same as width of the narrow section 32*b*, and the thin-walled portion 62 may be overlapped by the narrow section 32*b* so as to be concealed by the narrow section 32*b*.

In the previously described embodiment, the pressure chamber 26 has a shape which is long in one direction. However, it is not limited to having this kind of shape. For example, the shape of the pressure chamber may be a circular shape or a square shape.

The piezoelectric actuator 22 of the previously described embodiment includes the insulating film 30, the lower electrode 32, the piezoelectric film 33, and the upper electrode 34. However, it may further include another film such as a protective film for protecting the upper electrode 34. The neutral surface of the piezoelectric actuator 22 in this case will be a neutral surface of a laminated body including also the above-described other film.

The embodiment described above applied the present teaching to an ink-jet head that jets ink onto a recording sheet to print an image or the like. However, the present teaching may be applied also to liquid jetting apparatuses used in a variety of applications besides printing of an image or the like. For example, it is possible for the present teaching to be applied also to a liquid jetting apparatus that jets a conductive liquid onto a substrate to form a conductive pattern on a substrate surface.

What is claimed is:

1. A liquid jetting apparatus comprising:

a channel substrate in which a pressure chamber is formed;

an insulating film provided on the channel substrate to cover the pressure chamber;

a piezoelectric film overlapping with the insulating film and having a first portion and a second portion, the first portion overlapping with a central portion of the pressure chamber in a first direction, the second portion extending from the first portion in the first direction beyond the pressure chamber, the first portion having a width in a second direction orthogonal to the first direction which is smaller than a width of the pressure chamber in the second direction;

a first electrode arranged between the insulating film and the piezoelectric film, the first electrode extending in the first direction across a boundary between the first portion and the second portion of the piezoelectric film; and a second electrode facing the first electrode with the piezoelectric film being sandwiched therebetween, the second electrode extending in the first direction across the boundary between the first portion and the second portion of the piezoelectric film, wherein the insulating film has a thin-walled portion formed at a portion overlapping with the second portion of the piezoelectric film, and the thin-walled portion is thinner than an uncovered portion, of the insulating film, which is not covered by the piezoelectric film and which is positioned outside the first portion of the piezoelectric film and inside the pressure chamber with respect to the second direction.

2. The liquid jetting apparatus according to claim 1, wherein the first electrode has: a first portion electrode overlapped with the first portion of the piezoelectric film; and a second portion electrode overlapped with the second portion of the piezoelectric film, and a width of the second portion electrode in the second direction is smaller than a width of the first portion electrode in the second direction.

3. The liquid jetting apparatus according to claim 2, wherein a boundary between the first portion electrode and the second portion electrode does not overlap with the thin-walled portion.

4. The liquid jetting apparatus according to claim 1, wherein the insulating film, the piezoelectric film, the first electrode, and the second electrode compose an actuator, the actuator has: a first part including the first portion of the piezoelectric film; and a second part including the second portion of the piezoelectric film, the first part of the actuator has a first neutral surface and the second part of the actuator has a second neutral surface, the first neutral surface is closer to the pressure chamber than a neutral surface of the piezoelectric film is, and the second neutral surface is closer to the neutral surface of the piezoelectric film than the first neutral surface is.

5. The liquid jetting apparatus according to claim 4, wherein the piezoelectric film has a first surface facing the insulating film, and the first neutral surface is closer to the pressure chamber than the first surface of the piezoelectric film is.

6. The liquid jetting apparatus according to claim 1, wherein the pressure chamber has a shape which is long in the first direction.

7. The liquid jetting apparatus according to claim 6, wherein one end of the pressure chamber in the first direction is overlapped with the thin-walled portion.

8. A liquid jetting apparatus comprising:

a channel substrate in which a pressure chamber is formed;

an insulating film provided on the channel substrate to cover the pressure chamber;

a piezoelectric film overlapping with the insulating film and having a first portion and a second portion, the first portion overlapping with a central portion of the pressure chamber in a first direction, the second portion extending from the first portion in the first direction beyond the pressure chamber, the first portion having a width in a second direction orthogonal to the first direction which is smaller than a width of the pressure chamber in the second direction;

a first electrode arranged between the insulating film and the piezoelectric film, the first electrode facing the first portion of the piezoelectric film;

a second electrode facing the first electrode with the piezoelectric film being sandwiched therebetween, the second electrode extending in the first direction across the boundary between the first portion and the second portion of the piezoelectric film; and a trace connected to the first electrode, the trace facing the second electrode with the second portion of the piezoelectric film being sandwiched therebetween, wherein the insulating film has a thin-walled portion formed at a portion overlapping with the second portion of the piezoelectric film, and the thin-walled portion is thinner than an uncovered portion, of the insulating film, which is not covered by the piezoelectric film and which is positioned outside the first portion of the piezoelectric film and inside the pressure chamber with respect to the second direction.

9. The liquid jetting apparatus according to claim 7, wherein a connection position of the trace and the first electrode does not overlap with the thin-walled portion.

10. The liquid jetting apparatus according to claim 8, wherein the pressure chamber has a shape which is long in the first direction.

* * * * *